US005353984A

United States Patent [19]

Liu et al.

[11] Patent Number: 5,353,984

[45] Date of Patent: Oct. 11, 1994

[54] FOLDABLE PAPER BOARD FOR FORMING A CONTAINER

[76] Inventors: Yuan-Hsin Liu, 11th-1 Floor, No. 90, Fu Hsin S. Road, Sec. 1, Tah An District, Taipei; Richard C. H. Chang, 19, Alley 2, Lane 685, Chung Cheng Road, Fuan Yuan City, Taichung Hsien, both of Taiwan

[21] Appl. No.: 135,600

[22] Filed: Oct. 13, 1993

[51] Int. Cl.[5] ..... B65D 5/20

[52] U.S. Cl. ..... 229/104; 229/114; 229/168; 229/171; 229/182

[58] Field of Search ..... 229/104, 114, 167, 168, 229/171, 182

[56] References Cited

U.S. PATENT DOCUMENTS

| | | | |
|---|---|---|---|
| 189,898 | 4/1977 | Morgan | 229/168 |
| 2,454,573 | 11/1948 | Scher | 229/104 |
| 2,762,148 | 9/1956 | Alcaraz | 229/171 |
| 3,227,355 | 1/1966 | Davidson | 229/167 |
| 3,858,787 | 1/1975 | Banburg et al. | 229/104 |
| 4,003,514 | 1/1977 | Graser | 229/171 |
| 4,130,236 | 12/1978 | Manizza | 229/186 |
| 4,253,602 | 3/1981 | Kulig | 229/171 |
| 4,553,671 | 11/1985 | Cheesman | 229/114 |
| 4,632,302 | 12/1986 | Manizza | 229/171 |

FOREIGN PATENT DOCUMENTS

| | | | |
|---|---|---|---|
| 2660909 | 10/1991 | France | 229/171 |
| 529897 | 12/1957 | Italy | 229/171 |

OTHER PUBLICATIONS

The Wiley Encyclopedia of Packaging Technology, John Wiley & Sons, pp. 514–528 (1986).

*Primary Examiner*—Gary E. Elkins
*Attorney, Agent, or Firm*—Bacon & Thomas

[57] ABSTRACT

A paper board having a desired pattern and a plurality of folding lines embossed thereon defining a polygonal bottom section, an inner peripheral wall section extending outwardly from each side of the bottom section and pairs of corner sections disposed between two adjacent inner peripheral wall sections permitting the formation of a container. Wall edge, outer wall and plate sections extending outwardly from each inner peripheral wall section may be folded outwardly and downwardly to the underside of the bottom section to form hollow walls of the container.

3 Claims, 3 Drawing Sheets

FOLDABLE PAPER BOARD FOR FORMING A CONTAINER

BACKGROUND OF THE INVENTION

The present invention relates to a non-slip paper-made container. The paper-made container is made from a paper board having an adequate thickness and cut into a predetermined pattern and embossed with folding lines. The folding lines define a bottom section and several wall sections projecting outward from the edges of the bottom section, whereby the paper board can be folded about the folding lines and heat-sealed to form a paper-made container which has hollow walls and a non-slip bottom.

Presently commercially available dishes or plates for containing foods mainly include conventional porcelain and paper or polymer made containers, wherein the polymer-made containers are integrally formed from foam material to have a flat rectangular or circular configuration. Such containers have a recessed bottom section for containing foods and can be used in combination with a food wrap to keep the foods fresh. However, such containers are not subject to natural decomposition after they are used and discarded, and therefore, will cause serious pollution of and detriment to the whole ecological environment that will cost the entire society higher price to protect the environment.

The paper-made container is manufactured from a paper board cut to a predetermined pattern and embossed with a plurality of folding lines which define a bottom section and several wall sections, whereby the paper board can be folded about the folding lines and heat-sealed to form a solid container with a basin-like bottom. At present, due to the limited cutting and folding techniques, such paper container is one-layer structure with undesirable thickness. Therefore, the overall structural strength of such paper container is not enough and the container is liable to break down and be damaged when it is used to contain relatively heavy foods and thus causes troubles in use. Moreover, either the polymer-made or paper-made container has a smooth bottom and therefore, in case of careless collision or movement, the container is liable to slide down to the floor and cause the foods therein to be spilled. As a result, even though the paper-made food container is subject to natural decomposition, it still has undesirable shortcomings. Therefore, an improved paper-made food container is still required.

It is therefore tried by the applicant to develop a paper-made container which has secured structure and can be conveniently used.

SUMMARY OF THE INVENTION

It is a primary object of the present invention to provide a non-slip paper-made container. The paper-made container is made from a paper board which has an adequate thickness and is cut into a predetermined pattern and embossed with a plurality of folding lines. The folding lines define a middle bottom section and several inner peripheral wall sections adjoining the bottom section and containing several corner sections. Each corner section is divided by three folding lines into two corner connection sections. An extended section extends outward from each inner peripheral wall section. The extended section each is divided by several parallel folding lines into a wall edge section, an outer peripheral wall section and a non-slip plate section. The wall edge section, outer peripheral wall section and non-slip plate section of each extended section can be folded about the folding lines toward an outer side of the corresponding inner peripheral wall section and heat-sealed thereto, making the non-slip plate section to attach to an underside of the bottom section such that a reinforced and heat-insulating hollow wall having an inner clearance is formed. Moreover, the non-slip plate sections attached to the underside of the bottom section give the paper-made container a non-slip bottom.

It is a further object of the present invention to provide the above non-slip paper-made container, wherein the shape of the bottom section (such as a triangle, square, rectangle, equilateral polygon, unequilateral polygon, etc.) can be changed to meet actual requirements of containing different kinds of food or articles. The number of inner peripheral wall sections, corner connection sections, wall edge sections, outer peripheral wall sections and non-slip plate sections can be accordingly adjusted so as to form a rectangular box-like container or a substantially circular (polygon) dish-like container.

It is still a further object of the present invention to provide the above non-slip paper-made container, wherein the width of the inner and outer peripheral wall sections can be adjusted to form dish-like, box-like or cup-like container with different wall heights.

BRIEF DESCRIPTION OF THE DRAWINGS

The structure, features, functions, and other objects of the present invention, and the technical means adopted to achieve the present invention can be best understood through the following detailed description of the preferred embodiments and the accompanying drawings wherein.

DETAILED DESCRIPTION OF THE PREFERRED EMBODIMENTS

The present invention is a non-slip paper-made container formed from a paper board made from pure fibers and additives being laminated to adequate thickness and coated with polyethylene to meet the FDA regulations. The paper board is cut to a paper pattern of predetermined configuration. The paper pattern is embossed with a plurality of folding lines which define a bottom section 11 with a predetermined shape (such as a triangle, square, rectangle, equilateral polygon, unequilateral polygon, etc.), and several outward extended sections 18 extending from respective peripheral edges of the bottom section 11. Each extended section 18 is formed with several parallel folding lines a, b, c, d, and e, whereby the paper pattern can be folded about the folding lines a, b, c, d, and e and heat-sealed to form a paper-made container 10 having one single bottom with non-slip periphery and several hollow walls with inner clearances, so that the paper container 10 is heat-insulating and non-slip.

Figure 1:
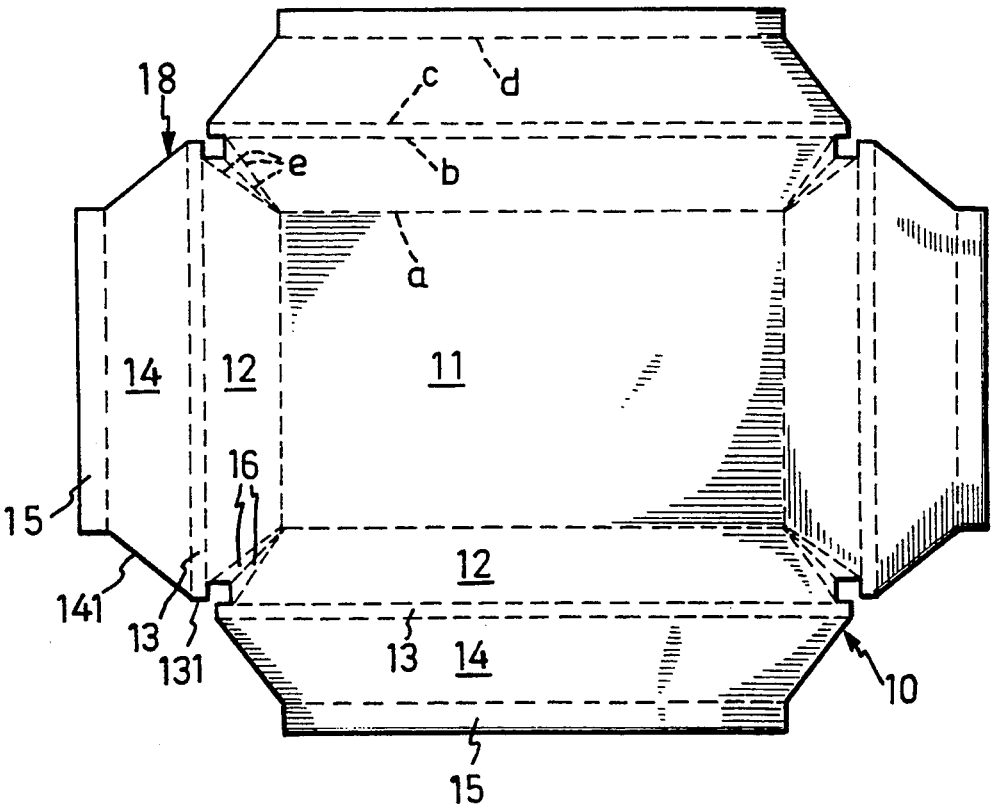
FIG. 1 is an unfolded paper pattern of a rectangular paper container according to the present invention
Figure 2:
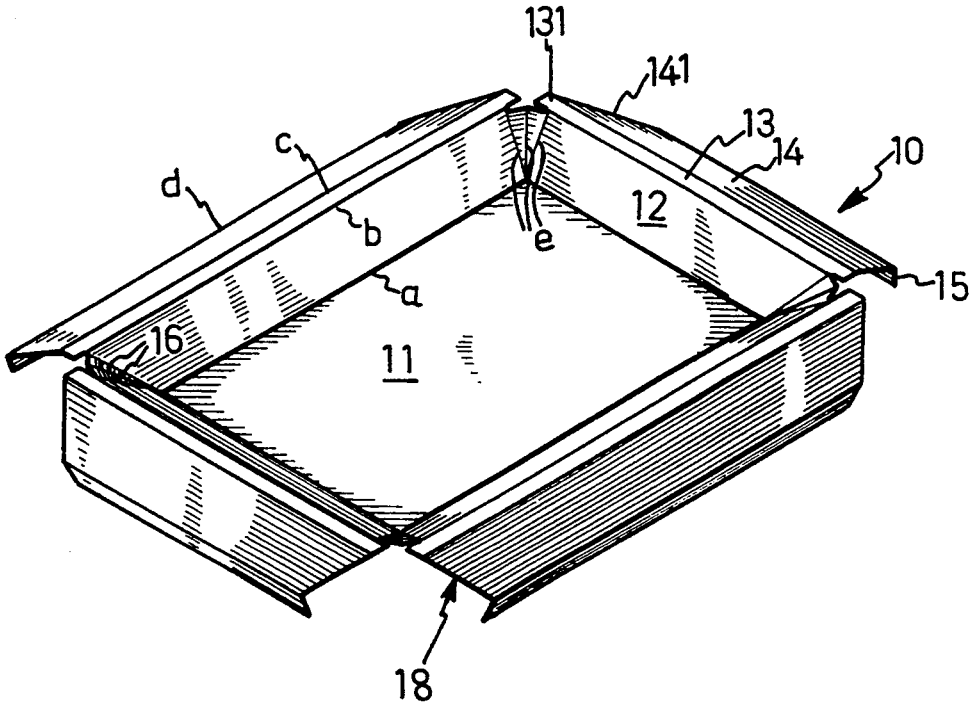
FIG. 2 shows the manner in which the paper container according to FIG. 1 is folded.

Please now refer to FIG. 1 which shows an unfolded paper pattern for forming a rectangular paper-made and dish-like container 10 of the present invention, wherein the folding lines a divide the paper pattern into a rectangular bottom section 11 and four inner peripheral wall sections 12. Each corner contained by two adjacent inner peripheral wall sections 12 is divided by three folding lines e into two corner connection sections 16, whereby each two adjacent corner connection sections 16 can be folded outward or inward about the folding lines e and heat-sealed, making the inner peripheral wall section 12 slightly inclined from an upright position and located around the bottom section 11 (as shown in FIG. 2). An extended section 18 extends outward from each inner peripheral wall section 12. The extended section 18 each is divided from inner side to outer side by several parallel folding lines b, c and d into a wall edge section 13, an outer wall section 14 and a non-slip plate section 15, wherein each of two ends of the wall edge section 13 is formed with a projection 131 and the outer peripheral wall section 14 is outward tapered, having two inclined sides 141 extending outward from two adjacent projections 131. The inner wall section 14 has a width substantially identical to that of the outer wall section 12. The non-slip plate section 15 adjoins the outer peripheral wall section 14 at folding line d.

Figure 3:
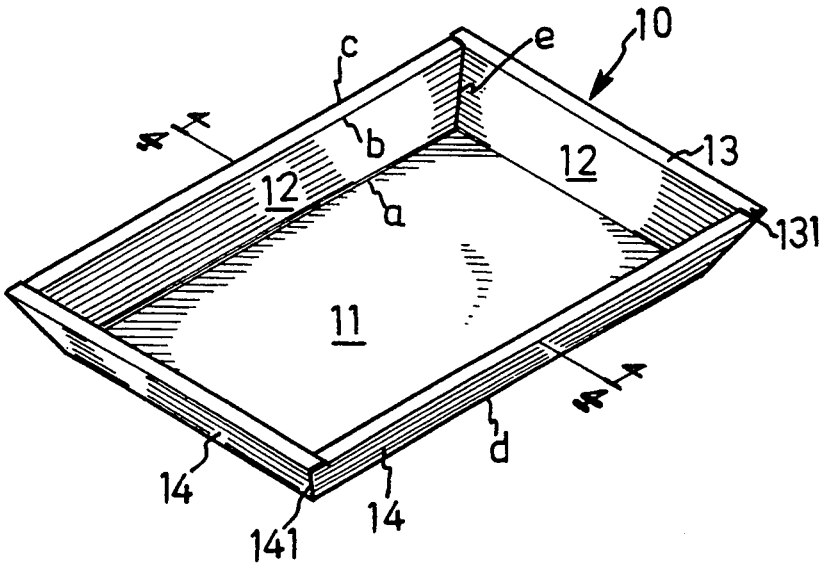
FIG. 3 shows the paper container folded, heat-sealed and finally formed from the paper pattern of FIG. 1.
Figure 4:
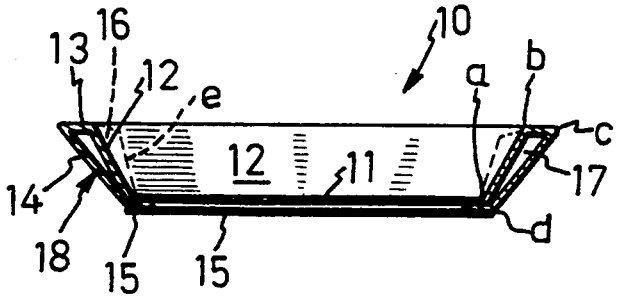
FIG. 4 is a vertical sectional view of the paper container according to FIG. 3.

Please now refer to FIGS. 3 and 4, wherein the extended section 18 can be outward folded about folding line b and the wall edge section 13, inner wall section 14 and non-slip plate section 15 can be further folded outward about the folding lines c and d to form a substantially C-shape pattern with the non-slip plate section 15 attached to and heat-sealed on a correspondingly sized portion of the bottom section 11 (as shown in FIG. 4) to form a hollow wall having an inner triangular cross-sectional configuration 17 which excellently reinforces the wall sections of the paper-made container 10 and gives the container 10 heat-insulating capability. Moreover, the non-slip plate sections 15 provide non-slip contact surface at the bottom of the paper-made container 10. In addition, the adjacent projections 131 of the wall edge sections 13 can be overlapped and heat-sealed together to reinforce the corner portions of the paper-made container 10.

To meet various requirements of containing different kinds of food or article, the paper-made container of the present invention can be designed to be right triangular, rectangular or polygonal in shape. The peripheral shapes of the bottom sections 11 can be changed by means of increasing or decreasing the numbers of the folding lines a. The inner peripheral wall sections 12 and corner connection sections 16 can be accordingly adjusted and the extended sections 18 can be similarly divided into the wall edge sections 13, outer peripheral wall sections 14 and non-slip plate sections 15 by the folding lines b, c and d in accordance with the adjusted inner peripheral wall sections 12. As previously recited, the corner connection sections 16 can be similarly folded and heat-sealed to form various kinds of paper-made and dish-like container having a bottom 11 in different shapes.

According to the above arrangements, the shape of the bottom section 11 can be changed and the numbers of the extended sections 18 can be accordingly increased or decreased to form paper-made containers 10 in various shapes. Furthermore, the width of the inner and outer peripheral wall sections 12, 14 can be adjusted to form dish-like, box-like or cup-like paper-made container with different wall heights. As a result, the present invention can be widely applied in various conditions.

In conclusion, the shapes of the bottom section and related sections of the paper-made container of the present invention can be freely varied to contain various kinds of foods or articles and the paper container is more practical in use. Moreover, the paper-made container of the present invention is easy to manufacture and convenient in use.

It is to be understood that the above description and drawings are only used for illustrating one embodiment of the present invention, and not intended to limit the scope of the present invention. Any variation and derivation from the above description and drawings should be included in the scope of the present invention.

What is claimed is:

1. A paper board cut into a pattern of predetermined configuration and embossed with a plurality of folding lines for permitting the board to be folded into a container, which paper board comprises:

a) a bottom section having at least three peripheral edges, each of which being defined by a first folding line;

b) an inner peripheral wall section adjoining each first folding line and extending outwardly from the bottom section and terminating at a second folding line;

c) an extended section extending outwardly from each second folding line, each extended section further including third and fourth folding lines defining, respectively, from the second folding line a wall edge section, an outer wall section and a plate section, each wall edge section having two outer projections, each outer wall section having two inclined sides tapering outwardly from the outer projections, and each plate section being of a size substantially equal to the size of a corresponding portion of the bottom section;

d) a corner section disposed between two adjacent inner peripheral wall sections, each corner section being defined by three folding lines which form two corner connection sections for heat sealing together; and e) whereby each extended section may be folded outwardly and downwardly for attaching the plate section to the underside of the bottom section and form a hollow wall of the container.

2. The paper board of claim 1 wherein the board is formed of laminated paper fibers and coated with polyethylene.

3. The paper board of claim 1 wherein each hollow wall of the container has a substantially triangular cross-sectional configuration.

* * * * *